US005911617A

United States Patent [19]

Chou

[11] Patent Number: 5,911,617

[45] Date of Patent: Jun. 15, 1999

[54] STRUCTURE OF MOTION TOY

[76] Inventor: Jin-Long Chou, 10F, No. 218, Sec. 3, Da-Tung Road, Hsi-Chin Chen, Taipei Hsien, Taiwan

[21] Appl. No.: 09/014,102

[22] Filed: Jan. 27, 1998

[51] Int. Cl.[6] ..... A63H 11/00; A63H 3/20

[52] U.S. Cl. ..... 446/353; 446/330

[58] Field of Search ..... 446/353, 354, 446/356, 358, 352, 330; 40/411, 415, 417, 418, 419, 420

[56] References Cited

U.S. PATENT DOCUMENTS

| | | | |
|---|---|---|---|
| 674,970 | 5/1901 | Kennedy | 40/411 |
| 711,510 | 10/1902 | Little | 40/419 |
| 1,415,344 | 5/1922 | Haskell . | |
| 1,423,383 | 7/1922 | Zaiden . | |
| 1,674,943 | 6/1928 | Berger . | |
| 1,685,358 | 9/1928 | Harcourt . | |
| 2,637,936 | 5/1953 | Dale et al. | 40/411 |
| 2,691,845 | 10/1954 | Jepson | 40/411 X |
| 3,613,299 | 10/1971 | Amici et al. . | |
| 3,643,374 | 2/1972 | Gunther et al. . | |
| 3,660,931 | 5/1972 | Gardel et al. . | |
| 3,888,023 | 6/1975 | Genin . | |
| 4,040,206 | 8/1977 | Kimura . | |
| 4,545,775 | 10/1985 | Kim | 446/353 X |
| 4,676,764 | 6/1987 | Yeu . | |
| 4,801,285 | 1/1989 | Yeu . | |
| 4,828,530 | 5/1989 | Lee | 40/419 X |
| 4,836,819 | 6/1989 | Oishi et al. . | |
| 4,846,752 | 7/1989 | Combs . | |
| 4,867,730 | 9/1989 | Lee . | |
| 4,869,703 | 9/1989 | Ong | 446/353 |
| 4,878,878 | 11/1989 | Bittner | 446/330 X |
| 4,901,459 | 2/1990 | Lee . | |
| 4,944,708 | 7/1990 | Kawabe . | |
| 5,147,238 | 9/1992 | Kelley et al. . | |
| 5,176,560 | 1/1993 | Wetherell et al. . | |
| 5,224,896 | 7/1993 | Terzian . | |
| 5,259,806 | 11/1993 | Chang . | |
| 5,609,340 | 3/1997 | Chuang . | |
| 5,735,726 | 4/1998 | Cohen . | |

FOREIGN PATENT DOCUMENTS

| | | | |
|---|---|---|---|
| 2221401 | 2/1990 | United Kingdom | 446/353 |

*Primary Examiner*—Kien T. Nguyen
*Assistant Examiner*—D. Neal Muir
*Attorney, Agent, or Firm*—Beveridge, Degrandi, Weilacher & Young LLP

[57] ABSTRACT

A motion toy includes a toy body having an upper part and a lower part pivotally connected together, and a power drive coupled between the upper part and the lower part of the toy body. The power drive is controlled to tilt the upper part and the lower part of the toy body alternatively inward and outward in reversed directions.

10 Claims, 8 Drawing Sheets

STRUCTURE OF MOTION TOY

BACKGROUND OF THE INVENTION

The present invention relates to motion toys, and more particularly to a motion toy which uses a reversible motor to turn a transmission gear through a belt transmission mechanism in moving two main racks on two foot cover shells in reversed directions, causing the upper part and the lower part of the toy body to alternatively tilt inward and outward in reversed directions.

A variety of motion toys have been disclosed and have appeared on the market. These motion toys commonly use a motor to turn a transmission gear train, causing the transmission gear train to move eccentric rods or cams, so as to move movable parts of the toy back and forth. This motion mode is monotonous and less attractive.

SUMMARY OF THE INVENTION

The present invention provides a motion toy which comprises a toy body, and a power drive mounted inside the toy body and controlled to move the toy body, causing the toy body to twist. The toy body comprises two symmetrical shoulder cover shells connected together; two foot plates; two trunk cover shells respectively connected to the shoulder cover shells, the trunk cover shells each having a pair of racks bilaterally disposed at a bottom side; two symmetrical waist cover shells respectively each having a top end respectively pivoted to the shoulder cover shells between the trunk cover shells and a bottom end; a bottom bracket coupled between the bottom ends of the waist cover shells and turned about a pivot between the trunk cover shells; and two symmetrical pairs of foot cover shells bilaterally connected between the foot plates and the waist cover shells, the foot cover shells each having a top end respectively pivoted to the bottom ends of the waist cover shells, a bottom end respectively pivoted to the foot plate, a main rack coupled to the power drive, and an auxiliary rack respectively meshed with the racks on the trunk cover shells. The power drive comprises a motor mount pivotably connected between the shoulder cover shells and the trunk cover shells by pivot means; a reversible motor mounted on the motor mount; a belt transmission mechanism; a transmission gear meshed between the main racks on the foot cover shells and coupled to the reversible motor through the belt transmission mechanism, the transmission gear moving the main racks alternatively up and down when the reversible motors is turned clockwise and counter-clockwise alternatively, causing the foot cover shells and the upper part of the toy body to be alternatively tilted inward and outward in reversed directions.

DETAILED DESCRIPTION OF THE PREFERRED EMBODIMENT

Figure 1:
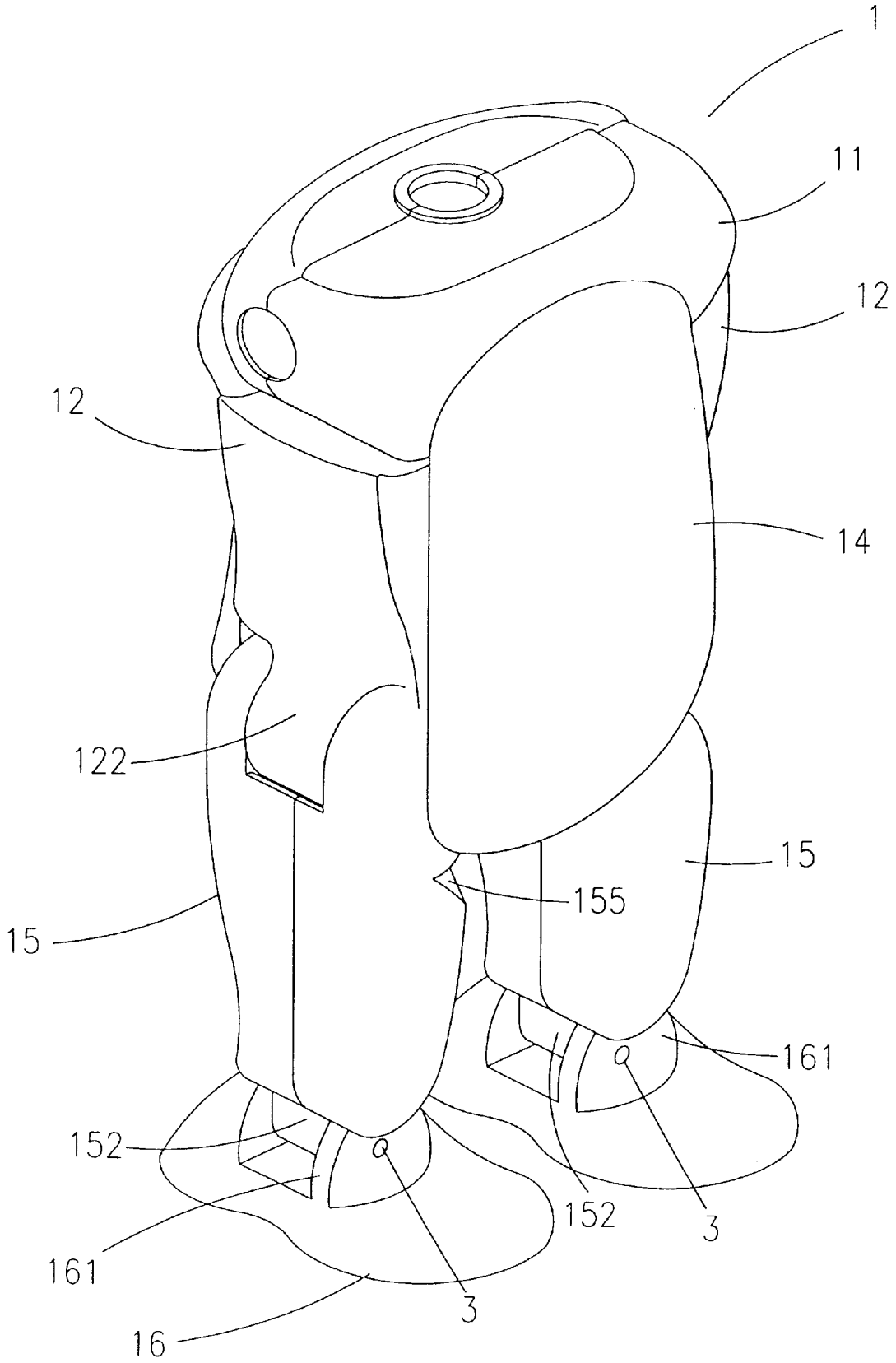
FIG. 1 is a perspective view of the present invention.
Figure 2:
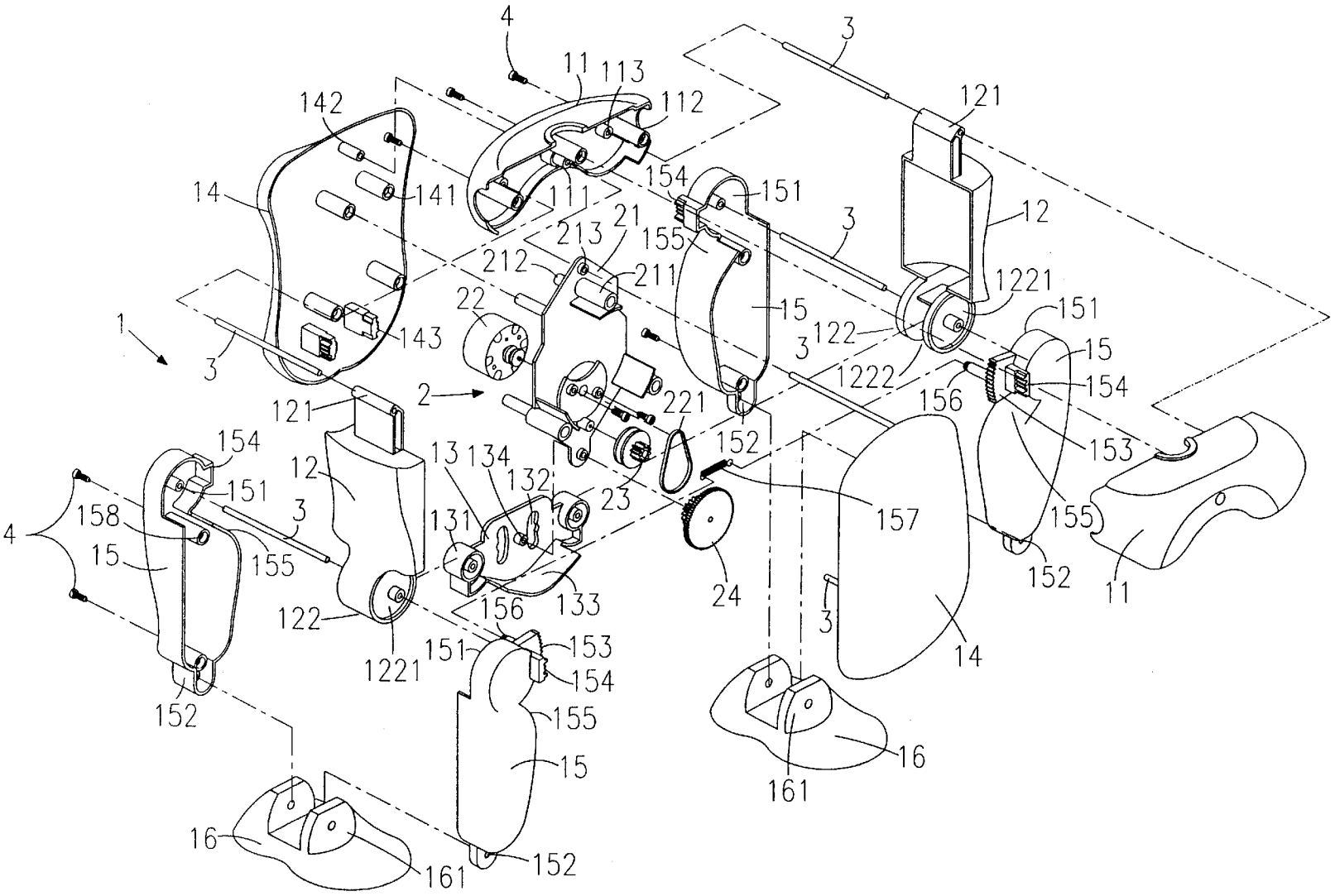
FIG. 2 is an exploded view of FIG. 1.
Figure 3:
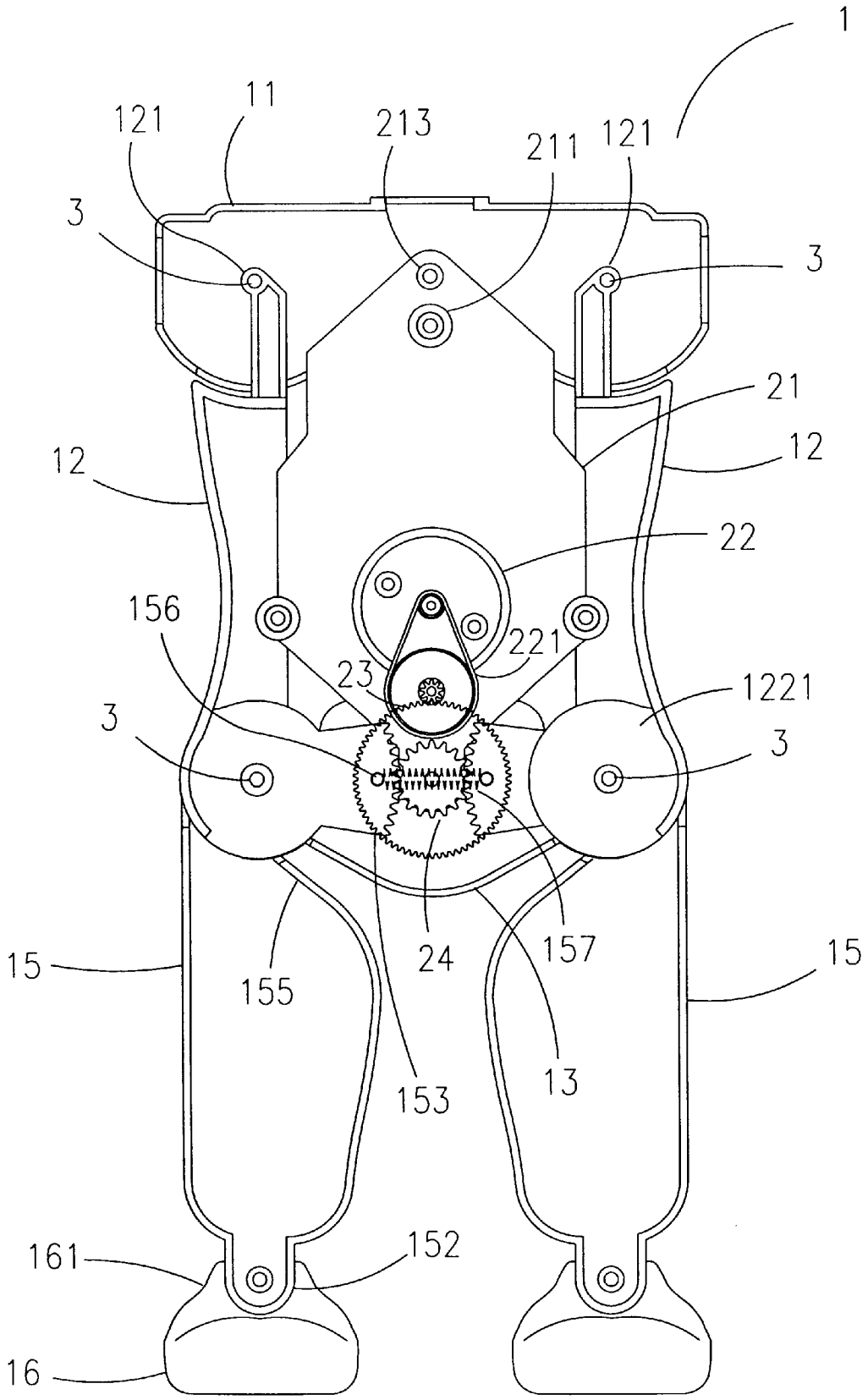
FIG. 3 is a front view in section of the present invention, showing the main racks on the foot cover shells meshed with the transmission gear.
Figure 4:
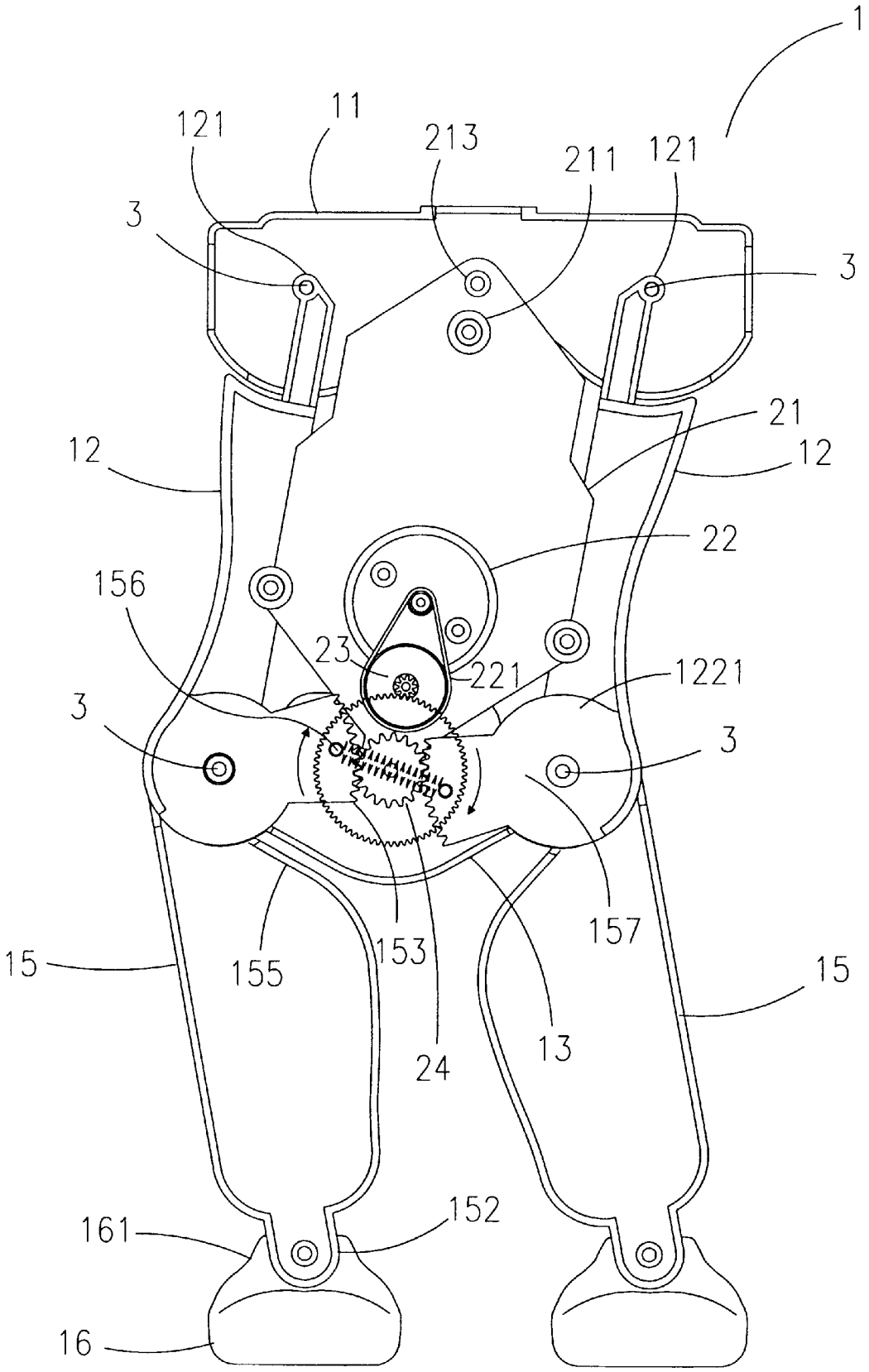
FIG. 4 illustrates the motion toy according to the present invention in operation, with the transmission gear turned clockwise.
Figure 5:
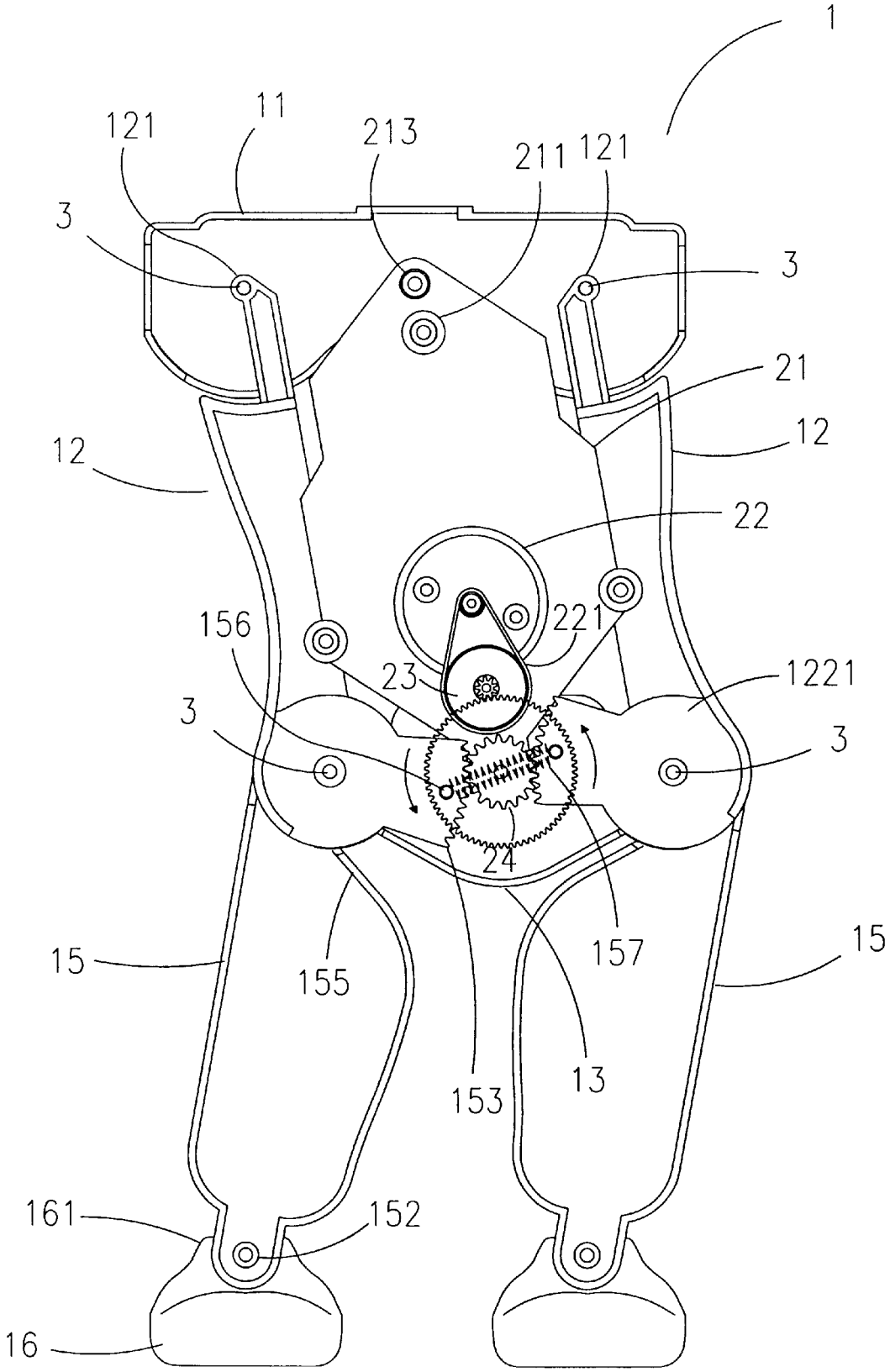
FIG. 5 illustrates the motion toy according to the present invention in operation, with the transmission gear turned counter-clockwise.

Referring to FIGS. 1 and 2, a motion toy in accordance with the present invention is generally comprised of a toy body 1, a power drive 2, and a plurality of pivot pins 3.

Figure 6:
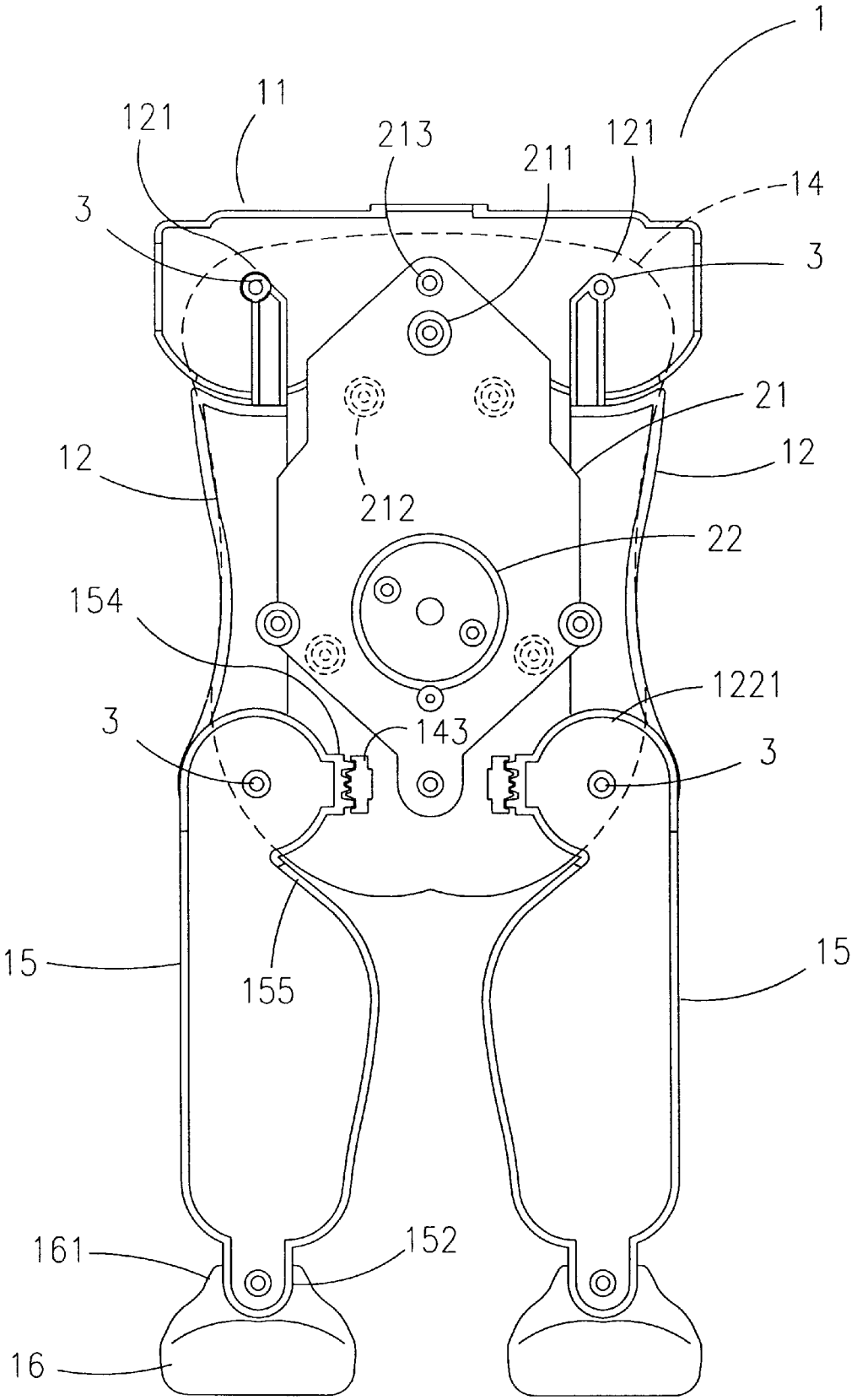
FIG. 6 is a front view in section of the present invention, showing the auxiliary racks on the foot cover shells meshed with the racks on the trunk cover shells.
Figure 7:
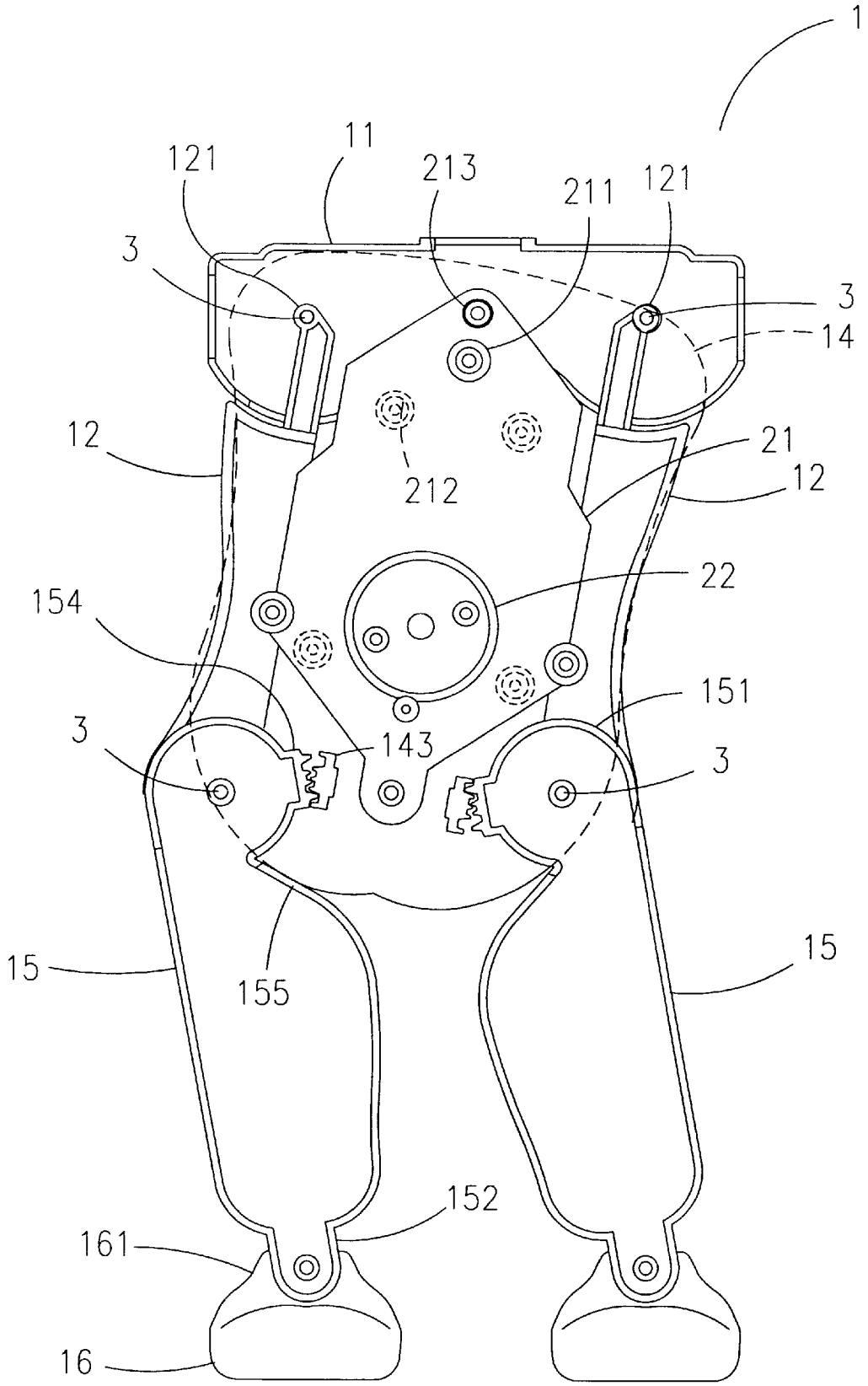
FIG. 7 is similar to FIG. 6 but showing the transmission gear turned clockwise and the toy body twisted.
Figure 8:
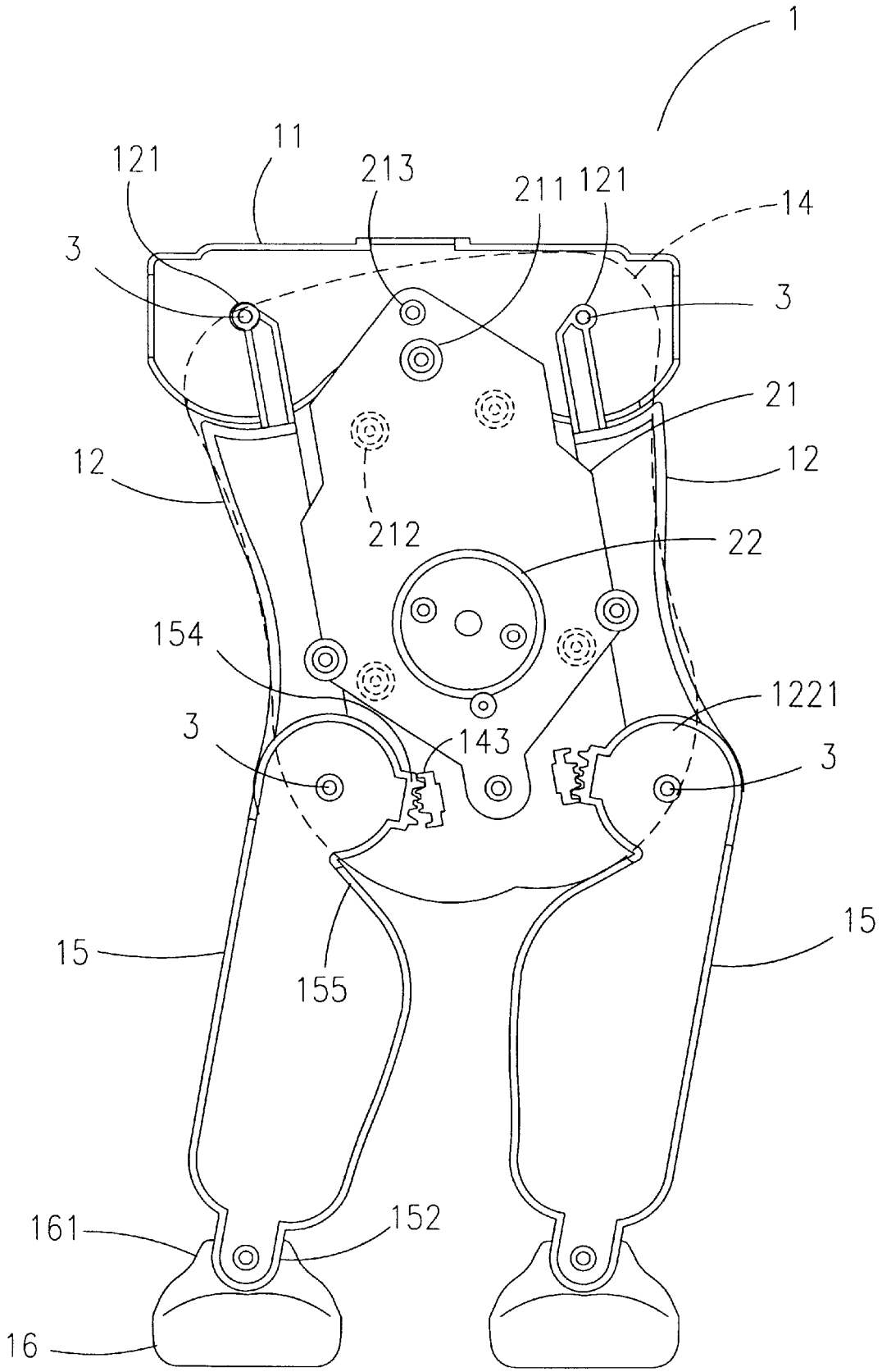
FIG. 8 is similar to FIG. 7 but showing the state where the transmission gear is turned counter-clockwise, and the toy body is twisted.

The toy body 1 is comprised of two symmetrical shoulder cover shells 11 connected together at the top, two symmetrical trunk cover shells 14 respectively connected to the shoulder cover shells 11, two symmetrical waist cover shells 12 respectively connected to the shoulder cover shells 11 between the trunk cover shells 14, a bottom bracket 13 connected between the waist cover shells 12 at the bottom, two foot plates 16, and two symmetrical pair of foot cover shells 15 bilaterally connected between the foot plates 16 and the waist cover shells 12. Three screws 4 are respectively mounted in respective mounting tubes 112 on one shoulder cover shell 11 and threaded into respective female screws (not shown) on the other shoulder cover shell 11 to secure the shoulder cover shells 11 together. Two pivot pins 3 are mounted in respective pivot holes 113 on the shoulder cover shells 11 and a respective pivot hole 121 at each waist cover shell 12 to pivotably secure the waist cover shells 12 to the shoulder cover shells 11 at two sides. Each waist cover shell 12 has a bottom coupling frame structure 122 comprised of two fixed disks 1221 and a receiving space 1222 defined between the fixed disks 1221. The foot cover shells 15 each have a top coupling portion 151 respectively covering the fixed disks 1221 of the waist cover shells 12 and pivotably secured thereto by a respective pivot pin 3, and a bottom lug 152 respectively pivotably connected to upright lugs 161 on the foot plates 16 by a respective pivot pin 3. The bottom bracket 13 has two barrels 131 at two opposite ends respectively inserted in the receiving spaces 1222 on the waist cover shells 12 and pivotably connected between the fixed disks 1221 on the waist cover shells 12 by the pivot pins 3 which are fastened to the fixed disks 1221. Two of the foot cover shells 15 have a respective locating rod 156 inserted through a respective arched slot 132 on the bottom bracket 13, and a tensile spring 157 is connected between the locating rods 156. The bottom bracket 13 has a smoothed arched bottom limit plate 133. The two foot cover shells 15 of the same pair are fastened together by plugging plug rods (not shown) on one foot cover shell into respective locating tubes 158 on the other. The power drive 2 comprises a motor mount 21 connected between the waist cover shells 12, a reversible motor 22 mounted on the motor mount 21, a belt wheel 23, a transmission belt 221 coupled between the reversible motor 22 and the belt wheel 23, and a transmission gear 24 coupled to the belt wheel 221. A pivot pin 3 is mounted in respective pivot holes 111 on the shoulder cover shells 11 and a top pivot hole 213 on the motor mount 21 to suspend the motor mount 21. A pivot pin 3 is fixedly perpendicularly fastened to one trunk cover shell 14 on the inside and inserted through the center hole on the transmission gear 24 and fastened to an axle hole 134 on the bottom bracket 13 between the arched slots 132, permitting the transmission gear 24 to be meshed between main racks 153 on the foot cover shell 15. The trunk cover shells 14 each have a pair of racks 143 respectively meshed with auxiliary racks 154 on the foot cover shells 15 (see also FIG. 6). The motor mount 21 has a plurality of mounting tubes 211 at one side respectively forced into engagement with respective mounting rods (not shown) on one trunk cover shell 14, and a plurality of mounting rods 212 at an opposite side respectively forced into engagement with respective mounting tubes 141 on the other trunk cover shell 14. The truck cover shells 14 further have respective mounting rods 142 respectively plugged into respective mounting tubes 112 on the shoulder cover shells 11.

Referring to FIGS. from 3 to 5, when the reversible motor 22 is turned clockwise or counter-clockwise, the belt wheel 23 is driven by the transmission belt 221 to rotate the transmission gear 24, thereby causing the main racks 153 to be moved upward or downward in reversed directions. When the main racks 153 of the foot cover shells 15 are alternatively moved up and down, the foot cover shells 15 are forced to tilt inward and outward.

Referring to FIGS. from 6 to 8, because the auxiliary racks 154 on the foot cover shells 15 are respectively meshed with the racks 143 on the trunk cover shells 14, the upper part of the toy body 1, namely, the waist cover shells 12, the trunk cover shells 14 and the shoulder cover shells 11 are tilted outward and inward when the foot cover shells 15 are tilted inward and outward. Further, the foot cover shells 15 each have a recessed portion 155 at an inner side corresponding to the smoothly arched bottom limit plate 133 on the bottom bracket 13 (see FIGS. 1, 3, 4 and 5). Because of the design of the recessed portion 155 at each foot cover shell 15, the foot cover shells 15 can be tilted inward at an angle.

While only one embodiment of the present invention has been shown and described, it will be understood that various modifications and changes could be made thereunto without departing from the spirit and scope of the invention disclosed.

What the invention claimed is:

1. A movable toy comprising a toy body, and a power drive mounted inside said toy body and controlled to move said toy body, causing said toy body to twist, wherein said toy body includes two symmetrical shoulder cover shells connected together; two foot plates; two trunk cover shells respectively connected to said shoulder cover shells, said trunk cover shells each having a pair of racks bilaterally disposed at a bottom side; two symmetrical waist cover shells respectively each having a top end and a bottom end, wherein the top end is respectively pivoted to said shoulder cover shells between said trunk cover shells; a bottom bracket coupled between the bottom ends of said waist cover shells and pivotable about a pivot between said trunk cover shells; and two symmetrical pairs of foot cover shells bilaterally connected between said foot plates and said waist cover shells, said foot cover shells each having a top end respectively pivoted to the bottom ends of said waist cover shells, a bottom end respectively pivoted to said foot plate, a main rack coupled to said power drive, and an auxiliary rack respectively meshed with the racks on said trunk cover shells; and wherein said power drive includes a motor mount pivotably connected between said shoulder cover shells and said trunk cover shells by pivot means; a reversible motor mounted on said motor mount; a belt transmission mechanism; and a transmission gear meshed between the main racks on said foot cover shells and coupled to said reversible motor through said belt transmission mechanism, said transmission gear moving said main racks alternatively up and down when said reversible motor is turned clockwise and counter-clockwise alternatively, causing said foot cover shells and an upper part of said toy body to be alternatively tilted inward and outward in reversed directions.

2. The movable toy of claim 1, wherein said bottom bracket has two arched sliding slots; and wherein each pair of said foot cover shells has a respective locating rod respectively inserted through the arched sliding slots on said bottom brackets and connected to each other by spring means to limit a tilting angle of said foot cover shells.

3. A movable toy, comprising:

a toy body, wherein the toy body includes:

a first shoulder cover shell;

a second shoulder cover shell connected to the first shoulder cover shell;

a first trunk cover shell connected to the first shoulder cover shell;

a second trunk cover shell connected to the second shoulder cover shell;

a first waist cover shell pivotally connected to the first and second shoulder cover shells;

a second waist cover shell pivotally connected to the first and second shoulder cover shells;

a bottom bracket coupled between the first and second waist cover shells;

a first foot plate;

a second foot plate, a first foot cover shell connected between the first foot plate and the first waist cover shell, the first foot cover shell having a top end pivotally connected to the first waist cover shell and a bottom end pivotally connected to the first foot plate; and a second foot cover shell connected between the second foot plate and the second waist cover shell, the second foot cover shell having a top end pivotally connected to the second waist cover shell and a bottom end pivotally connected to the second foot plate; and a power drive mounted inside the toy body, wherein the power drive includes a reversible motor that moves the toy body by causing the first and second foot cover shells to alternatively tilt in a different direction from the first and second waist cover shells.

4. A movable toy according to claim 3, wherein the first foot cover shell includes a first main rack operatively coupled to the power drive, and the second foot cover shell includes a second main rack operatively coupled to the power drive.

5. A movable toy according to claim 4, wherein the first foot cover shell includes a first auxiliary rack that movably engages with a first rack provided on one of the trunk cover shells, and the second foot cover shell includes a second auxiliary rack that movably engages with a second rack provided on one of the trunk cover shells.

6. A movable toy according to claim 3, wherein the first foot cover shell includes a first auxiliary rack that movably engages with a first rack provided on one of the trunk cover shells, and the second foot cover shell includes a second auxiliary rack that movably engages with a second rack provided on one of the trunk cover shells.

7. A movable toy according to claim 3, wherein the power drive includes a motor mount pivotally connected between the shoulder cover shells and the trunk cover shells, wherein the reversible motor is mounted on the motor mount.

8. A movable toy according to claim 3, wherein the power drive includes a motor mount pivotally connected between the shoulder cover shells and the trunk cover shells, wherein the reversible motor is mounted on the motor mount, wherein the first foot cover shell includes a first main rack operatively coupled to the power drive, and wherein the second foot cover shell includes a second main rack operatively coupled to the power drive.

9. A movable toy according to claim 8, wherein the first foot cover shell includes a first auxiliary rack that movably engages with a first rack provided on one of the trunk cover shells, and the second foot cover shell includes a second auxiliary rack that movably engages with a second rack provided on one of the trunk cover shells.

10. A movable toy according to claim 9, wherein the power drive includes a belt transmission mechanism and a transmission gear, wherein the transmission gear operatively engages with the first and second main racks on the foot cover shells and operatively couples to the reversible motor through the belt transmission mechanism, and wherein the transmission gear moves the first and second main racks alternatively up and down when the reversible motor is turned clockwise and counter-clockwise alternatively, causing the foot cover shells to tilt in a different direction from the first and second waist cover shells.

* * * * *